US006334506B1

(12) United States Patent
Hamrin et al.

(10) Patent No.: US 6,334,506 B1
(45) Date of Patent: Jan. 1, 2002

(54) MUFFLER ARRANGEMENTS AND METHODS

(75) Inventors: John E. Hamrin; Matthew W. Jones, both of Bloomington, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 09/637,099

(22) Filed: Aug. 10, 2000

(51) Int. Cl.[7] ..... F01N 1/02
(52) U.S. Cl. ..... 181/249; 181/272; 181/269
(58) Field of Search ..... 181/272, 269, 181/282, 255, 249

(56) References Cited

U.S. PATENT DOCUMENTS

| | | | | | |
|---|---|---|---|---|---|
| 3,672,464 | A | | 6/1972 | Rowley et al. | |
| 4,023,645 | A | | 5/1977 | Retka et al. | |
| 4,113,289 | A | | 9/1978 | Wagner et al. | |
| 4,267,899 | A | * | 5/1981 | Wagner et al. | 181/272 |
| 4,296,832 | A | * | 10/1981 | Kicinski | 181/255 |
| 4,325,460 | A | | 4/1982 | Hoppenstedt | |
| 4,361,206 | A | * | 11/1982 | Tsai | 181/255 |
| 4,368,799 | A | | 1/1983 | Wagner | |
| 4,580,657 | A | | 4/1986 | Schmeichel et al. | |
| 4,632,216 | A | * | 12/1986 | Wagner et al. | 181/255 |
| 4,719,988 | A | * | 1/1988 | Kinouchi | 181/273 |
| 4,969,537 | A | * | 11/1990 | Wagner et al. | 181/255 |
| 5,808,245 | A | * | 9/1998 | Wiese et al. | 181/255 |
| 5,892,186 | A | * | 4/1999 | Flugger | 181/252 |
| 6,082,487 | A | | 7/2000 | Angelo et al. | |

OTHER PUBLICATIONS

Declaration of John E. Hamrin dated Nov. 9, 2000, including Exhibits A–F.

* cited by examiner

*Primary Examiner*—Robert E. Nappi
*Assistant Examiner*—Kim Lockett
(74) *Attorney, Agent, or Firm*—Merchant & Gould P.C.

(57) ABSTRACT

A muffler for use with heavy duty trucks includes an outer wall defining an internal volume; an inlet tube oriented at least partially within the internal volume; an outlet tube construction oriented at least partially within the internal volume and including a diverging section and a choke extension; and a first baffle structure securing the outlet tube construction within the internal volume. A ratio of the diverging section axial length to the choke extension axial length is preferably less than 3:1. The first baffle structure defines an aperture arrangement therein to permit gas flow communication therethrough. A ratio of the total open area of the aperture arrangement to the perimeter, cross-sectional area of the first baffle structure is between 1:50 and 1:500. The mufflers are particularly useful for attenuating low frequency noise associated with the internal volume of cabs or sleepers in heavy duty trucks.

18 Claims, 8 Drawing Sheets

MUFFLER ARRANGEMENTS AND METHODS

TECHNICAL FIELD

This disclosure relates to silencers, such as mufflers. In particular, this disclosure relates to methods and arrangements for mufflers, which, in addition to normal attenuation duties, are particularly useful for silencing the types of noise associated in the cab environment of a truck, especially a heavy duty truck.

BACKGROUND

In the trucking industry, there is greater attention being paid to the comfort of the driver. The trucking industry typically uses heavy duty engines, on the order of a horsepower of 300–600 HP. These engines are typically noisy, emitting sound pressure levels on the order of 89–104 dB(A) at full throttle.

Because of the noise produced by these engines, there have been muffler arrangements of various types developed to reduce this noise. There are regulations to require noise abatement produced by heavy duty engines. By-and-large, the focus of these regulations has been directed to "drive-by" conditions. That is, the noise is measured from a position that is a set distance away from and external to the truck.

The cabs in trucks have been changing over the years to accommodate sleeping quarters. In some instances, the trucks are driven by a team, such that while one person is driving, the other person is resting or sleeping in the sleeping quarter of the cab. Thus, the noise level in the cab needs to be low enough to permit comfort for both the driver and for the team member who is resting.

SUMMARY

Silencers or muffler arrangements are described that, in certain preferred situations, are particularly useful for attenuating low frequency noise associated with the internal volume of cabs or sleepers in heavy duty trucks. In general, muffler arrangements described herein have an outer wall defining an internal volume; an inlet tube oriented at least partially within the internal volume; an outlet tube construction oriented at least partially within the internal volume and including a diverging section and a choke extension; and a first baffle structure securing the outlet tube construction within the internal volume. Muffler arrangements constructed according to principles described herein will have "extended chokes." In other words, in preferred constructions, a ratio of the diverging section axial length to the choke extension axial length is preferably less than 3:1. In many preferred embodiments, the first baffle structure defines an aperture arrangement therein to permit gas flow communication therethrough.

Methods of muffling heavy duty trucks and of installing mufflers will preferably utilize mufflers constructed according to principles described herein.

DETAILED DESCRIPTION

I. Truck Exhaust Noise

Figure 1:
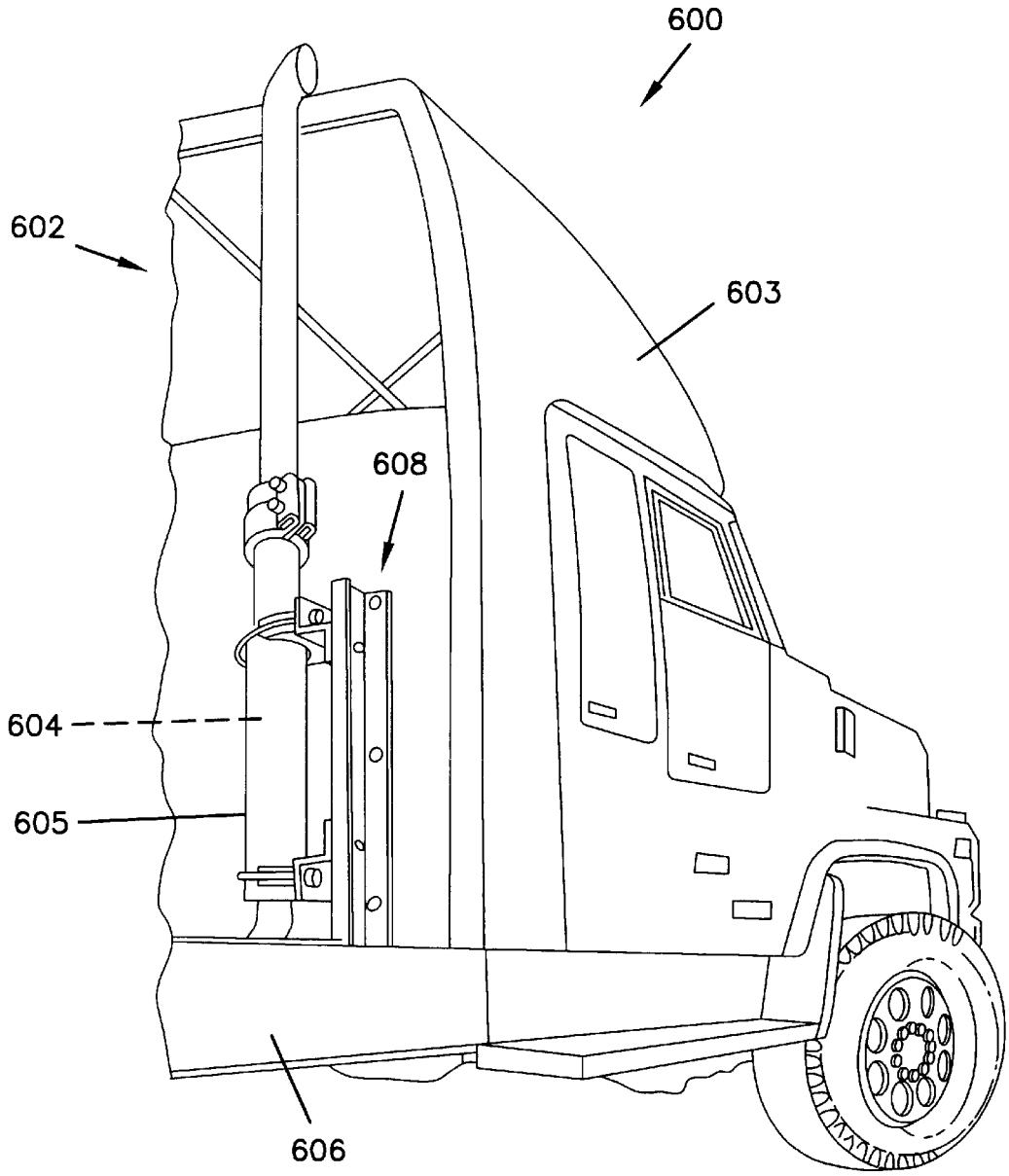
FIG. 1 is a schematic, perspective view of one embodiment of a truck, depicting its exhaust system.

In connection with the following discussions of preferred muffler designs, it should be understood that preferred mufflers designs need to achieve several principal objectives:

1. Satisfactory muffling of ordinary engine exhaust noise that includes both exhaust gas and muffler shell noise (referred to as positive power operation);
2. Offer no greater than acceptable levels of back pressure to the system, typically 40 inches of water (about 76 mm of mercury) maximum;
3. Satisfactory muffling of engine exhaust noise during both positive power and intermittent use of an engine compression brake, as assessed from within the cab of the truck; and
4. Meet size, weight, and shape criteria.

As used herein, the term "engine compression brake", and variants thereof, is used to refer to a type of diesel engine retarder that is used to slow down vehicles, such as trucks, by use of a device in the engine valve train that opens the exhaust valve a slight amount at the end of the usual compression stoke. As a result, the engine is turned into an inefficient pump. The energy input to this pump, i.e., to the engine, comes from the inertia of the moving truck through the power train. This pumping process significantly slows down the moving truck. When used, compression brakes can introduce a great deal of noise, both in exterior conditions and to the interior of the cab. More details about engine compression brakes, noise characteristics, and certain muffler systems used to address engine compression brake noise is described in U.S. Pat. No. 6,082,487, issued on Jul. 4, 2000, and application Ser. No. 09/571,342 filed May 16, 2000, which documents are incorporated herein by reference.

Regulations are in place with the intention of managing the issue of exhaust noise. In general, these regulations are intended to address the "total noise" heard by those outside of a truck. This is referred to as "drive-by" conditions. The testing procedures for compliance with the regulations mandate measurement of the noise from some certain distance away from the engine, and outside of the cab.

In the past, many muffler arrangements have been built and designed with the objective of complying with the government regulations. Many of these types of muffler arrangements have been focused on the drive-by noise level. It has been found, however, that muffler designs that address drive-by noise conditions may not necessarily address the noise problems inside of the cab of the truck.

With certain engines, the cab can be turned into a "drum", depending upon the geometry of the cab and the particular engine. Some cabs may resonate at the natural frequency that may be driven by the engine fundamental, creating permanent, standing waves in the interior volume of the cab. This aggravates noise conditions within the cab.

With drivers acting in teams (one driving while the other person rests), it becomes even more important to manage the noise level inside of the cab. In driving teams, the person not driving needs the cab to be quiet enough to permit rest, so that this person is well rested when taking over driving duties. Even without team driving approaches, it is desirable to improve the overall comfort of the driver. Driver comfort can lead to a less stressed and safe driver. In addition, any long term negative effects on the hearing ability of the driver are reduced with reduced in-cab noise.

II. In-Cab Noise Problems

Applicants have learned that exhaust noise, when measured in the interior of a truck's cab, is greatest for the low frequency octave bands, typically at or below 350 Hz. It is believed that low frequency octave bands are more of a problem than high frequency octave bands in the interior of cabs for a variety of reasons. For example, high frequency octave bands are often absorbed and muffled by the upholstery in the cab interior. Low frequency octave bands have longer wavelengths, which tend to resonate in the cab interior.

Historically, the focus of noise abatement for exhaust systems has been on total noise. Noise abatement, in general, has not been focused on attenuation of particular octave bands. By designing mufflers focused on low frequency attenuation, and with appropriate levels of attenuation on broad bands common to heavy duty engines, there can be compliance with the government noise abatement regulations for heavy duty trucks as well as reduced in-cab noise for the comfort of the occupants of the cab.

III. Techniques in Low Frequency Octave Band Attenuation

It has been found by applicants that certain techniques, when designed as part of overall muffler arrangements, will attenuate low frequency octave bands and address the problem of in-cab noise. In general, these techniques can be characterized as mufflers having outlet tubes with extended chokes. By "choke", "choke extension" or variations thereof it is meant the region of the muffler, typically a tube, that has the smallest cross-sectional area in which gas flow must pass through. A "choke extension" will have a length with an internal dimension, analogous to a diameter, that varies by no more than about 5% along its length. While typically cylindrical, a choke extension may vary somewhat from a true cylinder shape to accommodate dimples, beads, or a small amount of tapering. By "extended choke", it is meant a choke that has a length, when compared to certain other portions of the muffler, that is longer than many typical prior and conventional muffler arrangements. Typically, "extended chokes" will have a length that, when compared to the length of the diverging section, will have a preferred ratio (i.e., diverging section length to extended choke length ratio of under 3:1; many times, under 2:1; and in some cases, under 1:1.)

Further, it has been found that utilizing air flow passages, between a volume referred to as an "inlet chamber" and a volume referred to as an "outlet chamber," is also helpful (in connection with extended chokes) in low frequency attenuation by reducing back pressure and stabilizing overall temperature.

IV. Low Frequency Attenuation Techniques As Applied to Muffler Constructions

As mentioned above, the preferred muffler designs need to meet size, weight, shape criteria. In general, for typical heavy-duty trucks, the total vertical distance available for the positioning of the muffler is limited. Standard muffler shapes are cylindrical or oval. For cylindrically-shaped mufflers, the outer dimension will be a diameter. In preferred arrangements, the diameter should be typically no greater than 12 inches. Typical, conventional sizes for cylindrical mufflers for trucks, for example, for heavy duty trucks, have a nominal diameter of 11 inches or a nominal diameter of 10 inches. By "nominal diameter of 11 inches", it is meant an actual, measured diameter of 10.5 inch to just under 11.5 inch. By "nominal diameter of 10 inches", it is meant an actual, measured diameter of 9.5 inch to just under 10.5 inch. The inlet and outlet tubes typically are of a standard dimension, such that they can fit with other conventional, standardized tubing in an exhaust system. Typically, this diameter of the inlet and outlet tubes is about 5 inches. For typical heavy-duty trucks, the total vertical distance available for positioning the muffler is limited. The standard muffler lengths for a 10-inch diameter muffler is about 45 inches. With certain heavy-duty trucks, there is a vertical space of up to about 55 or 60 inches available. Many of these 55-inch mufflers will also have outer shell diameters of 11 inches.

To address the noise caused by heavy-duty engines experienced internally within the cab of the truck, certain preferred techniques to attenuate low frequency should be applied to the internal design of the muffler. In particular, it has been found that the choke should be made to be longer than conventional designs, on the order of at least 8 inches. For mufflers having an overall length of 55 inches and a diameter of 11 inches, the choke length should be on the order of at least 15 inches, and typically 17–25 inches. Mufflers having an overall length of 45 inches and a diameter of 10 inches should typically be designed with choke lengths at least 6 inches, and typically on the order of 8–15 inches. It is believed that mufflers, when designed with unusually long chokes such as those described herein, are better attenuated then previously existing mufflers to muffle low frequency octave bands that are often the source of noise inside of the cab of trucks.

Further, the choke should be designed to have a diameter that is no greater than 4 inches, and usually 3.5 inches or less.

Adjacent to the choke extension and leading to the outlet tube of the muffler, there should be included a tubular portion with a diverging or sloping sidewall. As used herein, this section will be referred to as a "diverging section." The length of the diverging section should usually be less than that of the length of the choke. For mufflers having a diameter of 11 inches, the length of the diverging section should usually be less than ⅔ of the length of the choke. In many instances, it is preferred to have the diverging section less than ⅗ of the length of the choke. For mufflers having a diameter of 10 inches, the length of the diverging section will usually be less than the length of the choke. In many instances, the diverging section is less than 90 percent of the length of the choke. Again, it has been found that when constructed according to these principles, there is a greater attenuation of low frequency octave bands than in previously existing mufflers.

The diverging section will typically have a greatest cross-sectional diameter of at least 4 inches, and often about 5 inches. The greatest cross-sectional diameter will be the widest cross-sectional portion of the diverging section. In these instances, the ratio of the cross-sectional area of the diverging section as compared to the cross-sectional area of the choke will be at least 2:1, and often at least 2.5:1.

In general, the choke should be a solid section, without perforations. The diverging section should usually have at least some perforations, and in some instances, be perforated for its entire length. In some instances, it has been found that the use of absorbent packing material may be used to attenuate certain octave bands, usually high frequency octave bands. It has been found that usually a full choke is preferred on the inlet tube, either through a star crimp or through a uncrimped, plugged end. By "star crimp", it is meant that the tube has a cross-sectional at its end region that is substantially different from the cross-section of the tube, sometimes resembling a star type of shape.

V. Example Mufflers

A. Mufflers Having a Shell Diameter of 11 Inches

Figure 3:
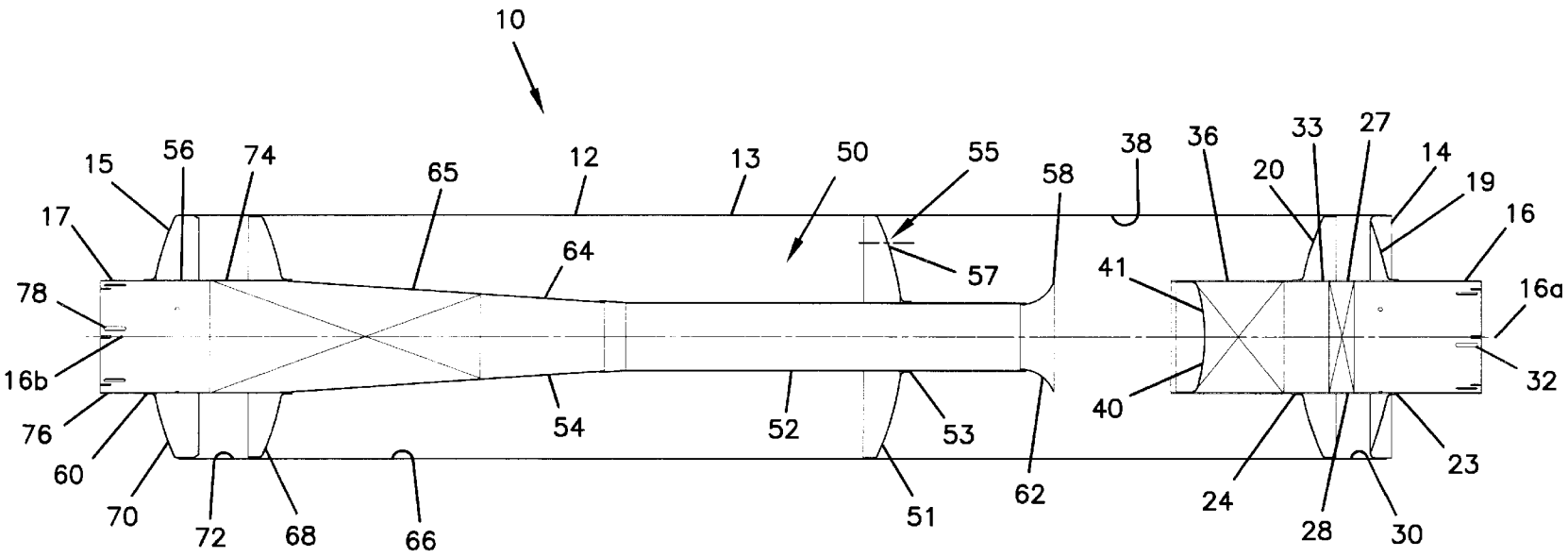
FIG. 3 is a schematic, cross-sectional view of a first embodiment of a muffler arrangement, constructed according to principles of this disclosure.

Attention is first directed to FIG. 3. In FIG. 3, a first improved muffler design constructed according to principles of this disclosure is generally presented. The specific muffler design of FIG. 3 has an overall outer diameter of about 11 inches. By "outer diameter", it is meant the largest dimension of a cross-section taken substantially perpendicular to a line from the inlet to the outlet. For typical mufflers, the outer shell is a cylindrical body, and the outer diameter is the diameter of this cylindrical body.

The overall length of the outer shell for the embodiment of FIG. 3 is about 55 inches. Herein, the term "length" refers to the length of the outer shell or the outer diameter body, i.e., to the longitudinal length of the wide part of the shell. That is, the length of tubes at the inlet and outlet are generally disregarded when this reference is made.

1. The Embodiment of FIG. 3

The arrangement of FIG. 3 is well adapted for use with heavy-duty trucks. The arrangement of FIG. 3 is particularly suitable for use with a dual exhaust system (DVV).

Referring still to FIG. 3, the improved muffler is generally indicated at reference number 10. The muffler 10 includes an outer casing, shell, or body 12 with an outer wall 13 having first and second opposite ends 14 and 15. The longitudinal distance between ends 14 and 15 preferably is about 55 inches.

The muffler 10 includes an inlet tube 16, projecting from end 14, and an outlet tube 17, projecting from end 15. In operation, engine noise and exhaust are directed into the muffler 10 through inlet tube 16, with the exhaust eventually passing outwardly through outlet tube 17. In general, in operation, muffler 10 will be positioned vertically, with inlet tube 16 toward the bottom. The preferred muffler 10 depicted has an "in-line" design. That is, a centerline 16*a* of the inlet tube 16 is substantially co-linear with a centerline 16*b* of the outlet tube 17. This avoidance of a substantially tortuous exhaust flow path inhibits flow loss (back pressure build up) during operation.

Inlet tube 16 is secured within end 14 by baffles 19 and 20. Baffle 19 is an end baffle enclosing end 14, and has a central aperture 23 through which inlet tubes 16 extends. Baffle 19 can be a standard baffle for an 11-inch diameter muffler.

As indicated previously, inlet tube 16 is also secured in position by extending through baffle 20. Baffle 20 is positioned secured against the outer shell 13 and spaced inwardly from the baffle 19 a distance of about 3–4 inches. Baffle 20 preferably is a solid, unperforated baffle. The baffle 20 includes a central aperture 24 through which inlet tube 16 extends, and by which inlet tube 16 is secured in position, for example through a weld. Note that the inlet tube 16 preferably includes a series of open grooves or slots 32. These slots 32 can be for aiding connection and clamping to other tubes in the exhaust assembly. Slots 32 are generally of a type described in U.S. Pat. No. 4,113,289, which patent is incorporated by reference herein.

Attention is now directed to region 27 of inlet tube 16. Region 27 preferably comprises a perforated section 28 of inlet tube 16 positioned between baffles 19 and 20. As a result of perforated section 28, exhaust gasses and exhaust sound entering muffler 10, through inlet tube 16, can expand into volume 30 between baffles 19 and 20. Volume 30 acts as an expansion-can resonator.

Continuing inwardly and away from end 14, the inlet tube 16 has a solid, unperforated region 33. Moving further inwardly from solid region 33, perforated region 36 is encountered. Perforated region 36 allows exhaust gasses and sound within inlet tube 16 to expand into volume 38 referred to herein as "inlet chamber."

Beyond perforated region 36, inwardly is positioned unperforated end section 40. Preferably, end section 40 is a non-crimped construction but can be crimped, in other embodiments. By "non-crimped", it is meant that the inlet tube has a cross-section at its end region that is not substantially different from the cross-section of the inlet tube. If circular, the inlet tube has a diameter at its end region that is not more or less than about 10 percent from the diameter of the rest of the inlet tube.

Inlet tube 16 is designed to function as a full choke. By "full choke", it is meant that the airflow through the inlet tube 16 must flow through a perforated region in the inlet tube, and if there is any opening axially in the inlet tube, the open area is smaller than one perforation. The full choke of the inlet tube 16 disrupts the airflow by, in this instance, plug 41 and forcing the air to flow through the perforated region 36.

Attention is now directed to the outlet tube construction. Outlet tube construction 50, in the embodiment illustrated, has four main regions: a choke extension 52; a diverging section 54; a bell mouth inlet 62; and an outlet section 56. The outlet tube construction 50 is secured within the shell 12 by baffle 51, baffle 68, and baffle 70. The outlet tube construction 50 has a total length, from end 58 to the portion 60 that ends at the end 15 of at least 30 in., typically 40–45 in. At the end 58 is a bell 62. The bell 62 helps to direct gas flow inwardly through the outlet tube construction 50. Adjacent to the bell 62 is the choke extension 52. The choke extension 52 is preferably cylindrical in shape, with a diameter of at least 2 inches, no greater than 4 inches, and typically 3–3.5 inches. The choke extension 52 will have a length at least 14 inches, no greater than 30 inches, and typically 18–25 inches. Among other things, the choke extension 52 functions to attenuate low frequency octave bands, on the order of 350 Hz and below.

Adjacent to the choke extension 52 and moving in a direction toward end 15, there is the diverging section 54. The diverging section 54 has a tapered or angled sidewall 64 that angles in a direction radially outwardly, extending from the choke 52 toward the outlet section 56. In particular, the sidewall 64 extends at an angle relative to the longitudinal axis 16*b* of at least 5°, no greater than about 13°, and typically about 8°. Preferably, the wall 64 has a circular cross-section, such that the diverging region 54 forms a frusto-conical section. A portion 65 of the diverging region 54 is perforated, to permit gas flow to travel from the outlet tube construction 50 into the volume 66. Volume 66, between baffle 51 and baffle 68 is referred to herein as "outlet chamber." The projected length of the diverging section 54 is at least 5 inches, no greater than 15 inches, and typically 8–12 inches. It can be seen that the preferred ratio of the length of the diverging section 54 to the length of the choke 52 is less than 1:1, typically less than 0.9:1 and in this case, about 0.7:1–0.8:1.

Adjacent to the diverging section 54 is the outlet tube section 56. This is defined as the section between the end 15 of the muffler 10 and the point at which the diverging wall 64 stops diverging and is shaped in a straight, cylindrical section. Note that baffles 68, 70 hold the outlet tube 50 in place relative to the outer shell 12 adjacent to the end 15. There is a volume 72 defined between baffle 68 and baffle 70. The extension 74 of outlet tube section 56 that extends between baffle 68 and baffle 70 is perforated, to allow exhaust gas to flow into the volume 72.

The outlet tube section 56 further continues from extension 74 to end 15. Beyond end 15, there is a portion 76 with a plurality of slots 78, which allows fastening and connection to other exhaust flow tubes.

The diverging section 54 will have a greatest area of diameter at the point in which it terminates, and where the outlet section 56 begins. The diameter of the diverging section 54 at this point will be greater than the diameter of the choke 52. In this case, the diameter of the diverging section 54 will be at least 4 inches, and typically about 5 inches. A ratio of the cross-sectional area of the diverging section as compared to the cross-sectional area of the choke will be greater than 2.0:1, typically greater than 2.5:1, and in this case, about 2.6–3.0:1.

Still in reference to FIG. 3, attention is directed to the baffle 51. The baffle 51 has an aperture 53 for accommodating the outlet tube construction 50. In referred embodiments, the aperture 53 is centered in the baffle 51. The baffle 51 also includes an aperture arrangement 55 to pennit gas flow between the inlet chamber 38 and the outlet chamber 66. The aperture arrangement 55 includes at least one, no more than ten, and in some cases four apertures extending completely through the baffle 51. In the particular embodiment illustrated in FIG. 3, there is a single aperture 57, sometimes referred to as a "bleed through aperture." Preferably, the aperture arrangement 55 will have a total open area, as compared to the total perimeter cross-sectional area of the baffle 51, that is sufficient to relieve the back pressure through the choke 52. Further, with the use of aperture arrangement 55, the outlet chamber 66 maintains a temperature close to the temperature of the inlet chamber 38. In addition, the aperture arrangement 55 helps to allow for an outlet tube construction 50 that is "anti-whistle bead free." In other words, the outlet tube construction 50 generally has a straight wall and is absent any indents or projections that are sometimes put in outlet tubes to prevent whistling. Anti-whistle beads are described in U.S. Pat. No. 4,023,645, incorporated by reference herein. Usable ratios of the total open area of the aperture arrangement as compared to the total, cross-sectional, perimeter area of the baffle 51 are as follows: at least 1:77, no greater than 1:484, and preferably 1:200–1:400. By the term "total cross-sectional, perimeter area of the baffle 51," it is meant the total area within the perimeter of the baffle 51, including the area occupied by the aperture arrangement and the area occupied by the aperture 53 (i.e., the "foot print" of the baffle 51"). In this instance, because the cross-sectional area of the baffle 51 is generally circular, the total cross sectional perimeter area of the baffle 51 is approximately $\pi r^2$.

2. The Embodiment of FIG. 4

Figure 4:
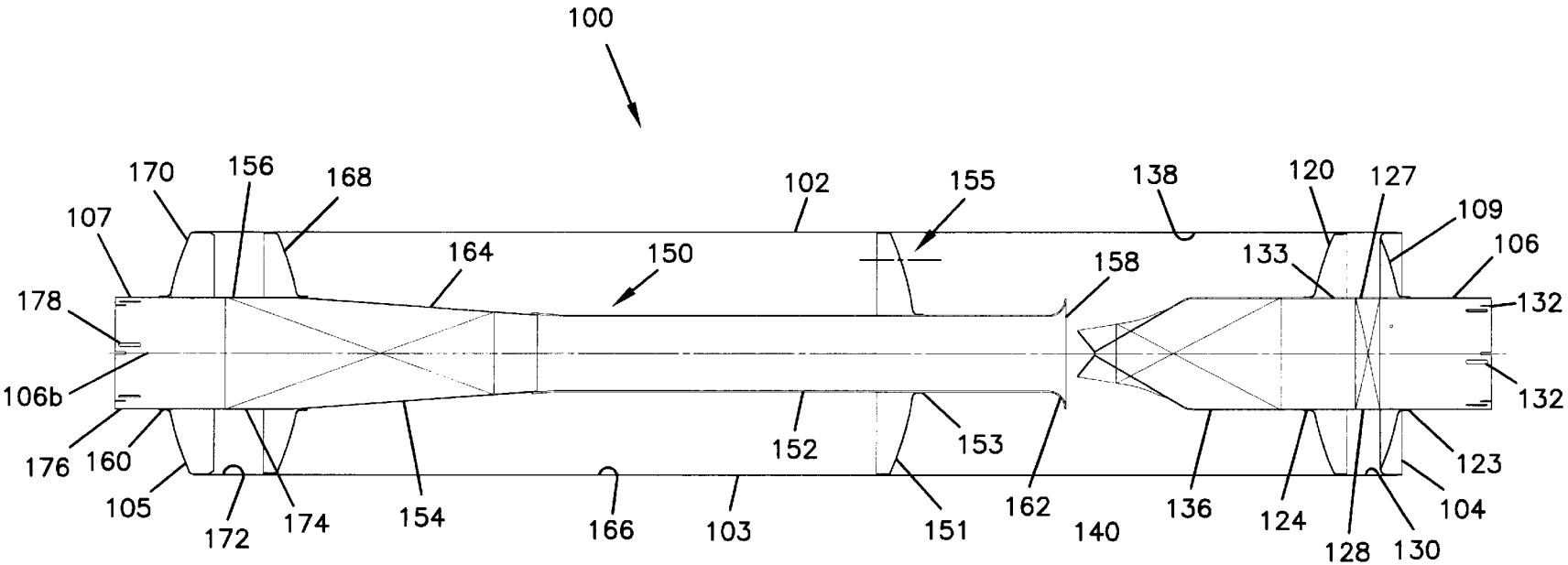
FIG. 4 is a schematic, cross-sectional view of a second embodiment of a muffler arrangement, constructed according to principles of this disclosure.

Attention is directed now to FIG. 4. In FIG. 4, another improved muffler design constructed according to principles of this disclosure is generally presented. The specific muffler design of FIG. 4, as with FIG. 3, has an overall outer diameter of about 11 inches and an overall length of the outer shell of about 55 inches. The muffler of FIG. 4 is particularly suited for use with a single vertical exhaust system (SVV).

Referring still to FIG. 4, the improved muffler is generally indicated at reference 100. The muffler 100 includes an outer casing, shell, or body 102 with an outer wall 103 having first and second opposite ends 104 and 105. The longitudinal distance between ends 104 and 105 preferably is about 55 inches.

The muffler 100 includes an inlet tube 106, projecting from end 104, and an outlet tube 107, projecting from end 105. In operation, engine noise and exhaust are directed into the muffler 100 through inlet tube 106, with the exhaust eventually passing outwardly through outlet tube 107.

Inlet tube 106 is secured within end 104 by baffles 109 and 120. Baffle 109 is an end baffle enclosing end 104, and has a central aperture 123 through which inlet tubes 106 extends. Baffle 109 can be a standard baffle for an 11-inch diameter muffler.

As indicated previously, inlet tube 106 is also secured in position by extending through baffle 120. Baffle 120 preferably is a solid, unperforated baffle. The baffle 20 includes a central aperture 124 through which inlet tube 106 extends, and by which inlet tube 106 is secured in position, for example through a weld. Note that the inlet tube 106 preferably includes open grooves or slots 132. These slots 132 can be for aiding connection and clamping to other tubes in the exhaust assembly.

Attention is now directed to region 127 of inlet tube 106. Region 127 preferably comprises a perforated section 128 of inlet tube 106 positioned between baffles 109 and 120. As a result of perforated section 128, exhaust gasses and exhaust sound entering muffler 100, through inlet tube 106, can expand into volume 130 between baffles 109 and 120. Volume 130 acts as an expansion-can resonator.

Continuing inwardly and away from end 104, the inlet tube 106 has a solid, unperforated region 133. Moving further inwardly from solid region 133, perforated region 136 is encountered. Perforated region 136 allows exhaust gasses and sound within inlet tube 106 to expand into volume 138.

Beyond perforated region 136, inwardly is positioned crimped section 140. The crimped section 140 is preferably perforated, and bent as described in U.S. Pat. No. 4,580,657, incorporated herein by reference. By "crimped", it is meant that the inlet tube has a cross-section at its end region that is substantially different from the cross-section of the inlet tube. For example, the outer periphery of the inlet tube at the end region may be bent inwardly toward the center of the tube, to a point where it either nearly touches or touches another portion of the periphery. As used in the construction herein, inlet tube 106 operates as a full choke.

Attention is now directed to the outlet tube construction. Outlet tube construction 150, in the embodiment illustrated, has four main regions: a choke extension 152; a diverging section 154; a bell 162; and an outlet section 156. The outlet tube construction 150 has a total length, from end 158 to the portion 160 that ends at the end 105 of at least 32 in., typically 40–48 in. At the end 158 is bell 162. The bell 162 helps to direct gas flow inwardly through the outlet tube construction 150. Adjacent to the bell 162 is the choke extension 152. The choke extension 152 is preferably cylindrical in shape, with a diameter of at least 2 inches, no greater than 4 inches, and typically 3.25–3.75 inches. The choke extension 152 will have a length at least 14 inches, no greater than 30 inches, and typically 18–25 inches. Among other things, the choke 152 functions to attenuate low frequency octave bands, on the order of 350 Hz and below.

Adjacent to the choke extension 152 and moving in a direction toward end 105, there is the diverging section 154. The diverging section 154 has a tapered or angled sidewall 164 that angles in a direction radially outwardly, extending from the choke 152 toward the outlet section 156. In particular, the sidewall 164 extends at an angle relative to the longitudinal axis 106*b* of at least 5°, no greater than about 13°, and typically about 8°. Preferably, the wall 164 has a circular cross-section, such that the diverging region 154 forms a frusto-conical section. The entire portion of the diverging region 154 is perforated, to permit gas flow to travel from the outlet tube construction 150 into the volume 166. The projected length of the diverging section 154 is at least 5 inches, no greater than 15 inches, and typically 8–12 inches. It can be seen that the preferred ratio of the length of the diverging section 154 to the length of the choke 152 is less than 1:1, typically less than 0.7:1 and in this case, about 0.5:1–0.6:1.

Adjacent to the diverging section 154 is the outlet tube section 156. This is defined as the section between the end 105 of the muffler 100 and the point at which the diverging wall 164 stops diverging and is shaped in a straight, cylindrical section. Note that there are pair of baffles 168, 170 that hold the outlet tube 150 in place relative to the outer shell 102 adjacent to the end 105. There is a volume 172 defined between baffle 168 and baffle 170. The extension 174 of outlet tube section 156 that extends between baffle 168 and baffle 170 is perforated, to allow exhaust gas to communicate with the volume 172.

The outlet tube section 156 further continues from extension 174 to end 105. Beyond end 105, there is a portion 176 with a plurality of slots 178, which allow fastening and connection to other exhaust flow tubes.

The diverging section 154 will have a greatest area of diameter at the point in which it terminates, and where the outlet section 156 begins. The diameter of the diverging section 154 at this point will be greater than the diameter of the choke 152. In this case, the diameter of the diverging section 154 will be at least 4 inches, and typically about 5 inches. A ratio of the cross-sectional area of the diverging section as compared to the cross-sectional area of the choke will be greater than 1.5:1, typically greater than 1.75:1, and in this case, about 2.0:1.

The baffle 151 has an aperture 153 for accommodating the outlet tube construction 150. In preferred embodiments, the aperture 153 is centered in the baffle 151. The baffle 151 also includes a bleed hole or an aperture arrangement 155 to permit gas flow between the inlet chamber 138 and the outlet chamber 166. The aperture arrangement 155 includes at least one, no more than ten, and in some cases four apertures extending completely through the baffle 151. As with the FIG. 3 embodiment, aperture arrangement 155 will have a total open area, as compared to the total perimeter cross-sectional area of the baffle 151, that is helpful in: relieving the back pressure through the choke 152; maintaining temperature of the outlet chamber 166 close to the temperature of the inlet chamber 138; and allowing for an anti-whistle bead free outlet tube construction 150. Usable ratios of the total open area of the aperture arrangement as compared to the total, cross-sectional, perimeter area of the baffle 151 are as follows: at least 1:77, no greater than 1:484, and preferably 1:250–1:350.

3. Common Properties of 11 Inch Mufflers.

In general, many preferred mufflers having shell diameters of 11 inches will have a choke length that is greater than the length of the diverging section. Typically, for example, the length of the diverging section will be less than ¾ and often less than ⅔ of the length of the choke (i.e., a ratio of diverging section length to choke length of less than 0.75:1, and often less than 0.67:1). The length of the choke will usually be at least 15 inches, and typically greater than 17 inches, with the length of the diverging section no greater than 22 inches, and usually at least 7 inches.

Many typical mufflers having shell diameters of 11 inches will also have an aperture arrangement or bleed hole through the baffle that separates the inlet chamber from the outlet chamber. The total open area of the aperture arrangement as compared to the total, cross-sectional, perimeter area of the baffle will generally, for example, be at least 1:50, no greater than 1:500, and typically 1:200–1:400. As explained above, the aperture arrangement helps to reduce back pressure through the choke, as compared to arrangements that would not have a bleed through aperture arrangement. Also, the aperture arrangement helps to maintain a uniform temperature throughout the interior volume of the muffler. Further, the aperture arrangement in the baffle allows for an anti-whistle bead free outlet tube construction.

For many mufflers, they will be constructed of metal, usually steel. Many parts are constructed of 14–20 gauge steel.

B. Mufflers Having a Shell Diameter of 10 Inches

1. The Embodiment of FIG. 5

Figure 5:
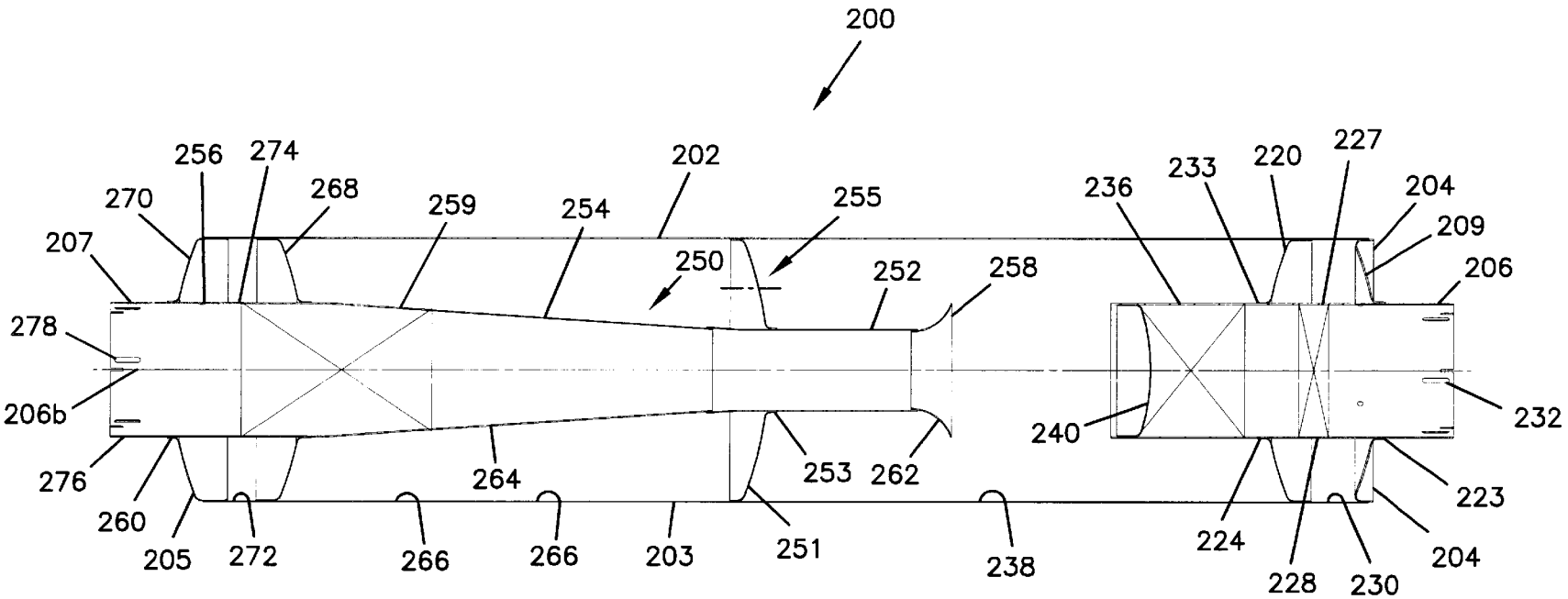
FIG. 5 is a schematic, cross-sectional view of a third embodiment of a muffler arrangement, constructed according to principles of this disclosure.

Attention is directed now to FIG. 5. In FIG. 5, another improved muffler design constructed according to principles of this disclosure is generally presented. The specific muffler design of FIG. 5 has an overall outer diameter of about 10 inches and an overall length of the outer shell of about 45 inches. The muffler of FIG. 5 is particularly suited for use with a dual vertical exhaust system (DVV).

Referring still to FIG. 5, the improved muffler is generally indicated at reference 200. The muffler 200 includes an outer casing, shell, or body 202 with an outer wall 203 having first and second opposite ends 204 and 205. The longitudinal distance between ends 204 and 205 preferably is about 45 inches.

The muffler 200 includes an inlet tube 206, projecting from end 204, and an outlet tube 207, projecting from end 205. In operation, engine noise and exhaust are directed into the muffler 200 through inlet tube 206, with the exhaust eventually passing outwardly through outlet tube 207.

Inlet tube 206 is secured within end 204 by baffles 209 and 220. Baffle 209 is an end baffle enclosing end 204, and has a central aperture 223 through which inlet tubes 206 extends. Baffle 209 can be a standard baffle for a 10-inch diameter muffler.

As indicated previously, inlet tube 206 is also secured in position by extending through baffle 220. Baffle 220 preferably is a solid, unperforated baffle. The baffle 220 includes a central aperture 224 through which inlet tube 206 extends, and by which inlet tube 206 is secured in position, for example through a weld. Note that the inlet tube 206 preferably includes open grooves or slots 232. These slots 232 can be for aiding connection and clamping to other tubes in the exhaust assembly.

Attention is now directed to region 227 of inlet tube 206. Region 227 preferably comprises a perforated section 228 of inlet tube 206 positioned between baffles 209 and 220. As a result of perforated section 228, exhaust gasses and exhaust sound entering muffler 200, through inlet tube 206, can expand into volume 230 between baffles 209 and 220. Volume 230 acts as an expansion-can resonator.

Continuing inwardly and away from end 204, the inlet tube 206 has a solid, unperforated region 233. Moving further inwardly from solid region 233, perforated region 236 is encountered. Perforated region 236 allows exhaust gasses and sound within inlet tube 206 to expand into volume 238.

Beyond perforated region 236, inwardly is positioned unperforated end section 240. Preferably end section 240 is a non-crimped construction. Inlet tube 206 is designed to function as a full choke.

Attention is now directed to the outlet tube construction 250. Outlet tube construction 250, in the embodiment illustrated, has four main regions: a choke extension 252; a diverging section 254; bell 262; and an outlet section 256. The outlet tube construction 250 has a total length, from end 258 to the portion 260 that ends at the end 205 of at least 25 in., typically 30–35 in. At the end 258 is bell 262. The bell 262 helps to direct gas flow inwardly through the outlet tube construction 250. Adjacent to the bell 262 is the choke extension 252. The choke extension 252 is preferably cylindrical in shape, with a diameter of at least 2 inches, no greater than 4 inches, and typically 3.0 inches. The choke extension 252 will have a length at least 5 inches, no greater than 30 inches, and typically 7–15 inches. Among other things, the choke extension 252 functions to attenuate low frequency octave bands, on the order of 350 Hz and below.

Adjacent to the choke extension 252 and moving in a direction toward end 205, there is the diverging section 254. The diverging section 254 has a tapered or angled sidewall 264 that angles in a direction radially outwardly, extending from the choke extension 252 toward the outlet section 256. In particular, the sidewall 264 extends at an angle relative to the longitudinal axis 206*b* of at least 5°, no greater than about 13°, and typically about 8°. Preferably, the wall 264 has a circular cross-section, such that the diverging region 254 forms a frusto-conical section. A portion 257 of the diverging region 254 is perforated, to permit gas flow to travel from the outlet tube construction 250 into the volume 266. The projected length of the diverging section 254 is at least 8 inches, no greater than 22 inches, and typically 14–17 inches. It can be seen that the preferred ratio of the length of the diverging section 254 to the length of the choke extension 252 is greater than 1.0:1, typically less than 3.0:1 and in this case, about 2:1.

Adjacent to the diverging section 254 is the outlet tube section 256. This is defined as the section between the end 205 of the muffler 200 and the point at which the diverging wall 264 stops diverging and is shaped in a straight, cylindrical section. Note that there are pair of baffles 268, 270 that hold the outlet tube 250 in place relative to the outer shell 202 adjacent to the end 205. There is a volume 272 defined between baffle 268 and baffle 270. The extension 274 of outlet tube section 256 that extends between baffle 268 and baffle 270 is perforated, to allow exhaust gas to flow into the volume 272.

The outlet tube section 256 further continues from extension 274 to end 205. Beyond end 205, there is a portion 276 with a plurality of slots 278, which allow fastening and connection to other exhaust flow tubes.

The diverging section 254 will have a greatest area of diameter at the point in which it terminates, and where the outlet section 256 begins. The diameter of the diverging section 254 at this point will be greater than the diameter of the choke extension 252. In this case, the diameter of the diverging section 254 will be at least 4 inches, and typically about 5 inches. A ratio of the cross-sectional area of the diverging section as compared to the cross-sectional area of the choke will be greater than 1.5:1, typically greater than 2.0:1, and in this case, about 2.8:1.

The baffle 251 has an aperture 253 for accommodating the outlet tube construction 250. As with the previously described embodiments, the baffle 251 also includes a bleed hole or an aperture arrangement 255 to permit gas flow between the inlet chamber 238 and the outlet chamber 266 and to achieve the advantages also described above. The aperture arrangement 255 includes at least one, no more than eight, and in some cases four apertures extending completely through the baffle 251. Usable ratios of the total open area of the aperture arrangement as compared to the total, cross-sectional, perimeter area of the baffle 251 are as follows: at least 1:77, no greater than 1:484, and preferably 1:275–1:325.

2. The Embodiment of FIG. 6

Figure 6:
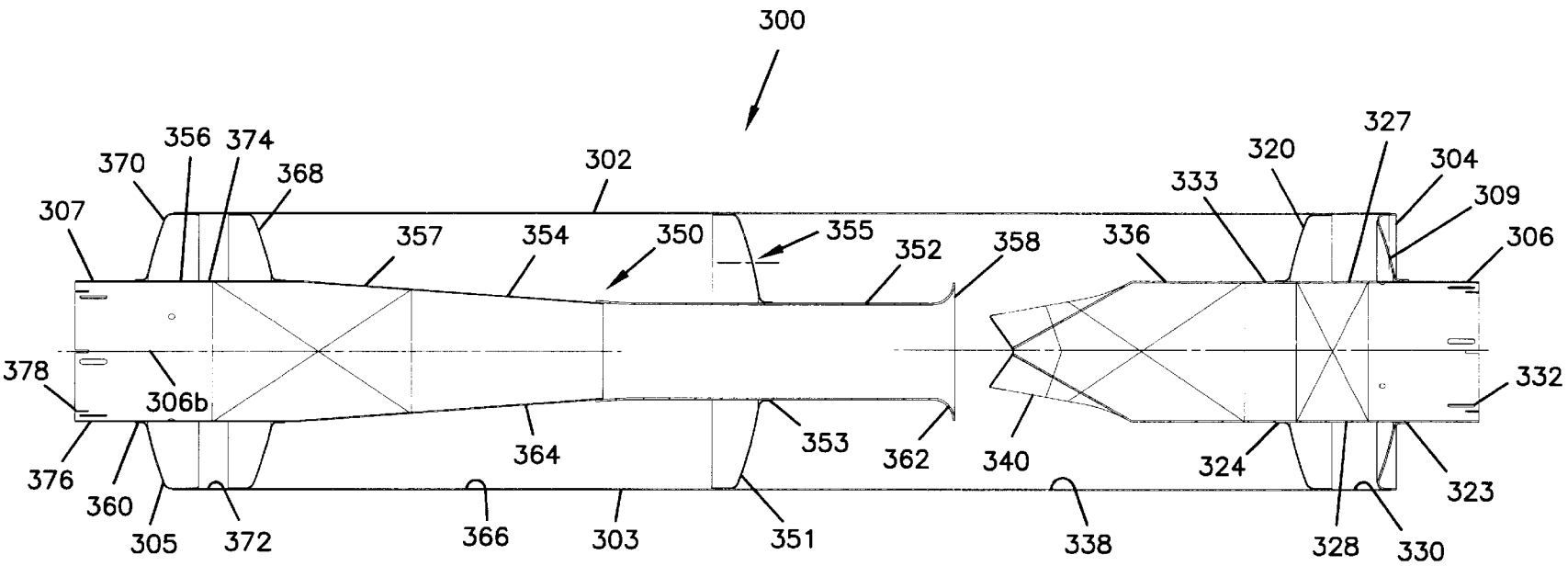
FIG. 6 is a schematic, cross-sectional view of a fourth embodiment of a muffler arrangement, constructed according to principles of this disclosure.

Attention is directed now to FIG. 6. In FIG. 6, another improved muffler design constructed according to principles of this disclosure is generally presented. As with the embodiment of FIG. 5, the specific muffler design of FIG. 6 has an overall outer diameter of about 10 inches and an overall length of the outer shell of about 45 inches. The muffler of FIG. 6 is particularly suited for use with a single vertical exhaust system (SVV).

Referring still to FIG. 6, the improved muffler is generally indicated at reference 300. The muffler 300 includes an outer casing, shell, or body 302 with an outer wall 303 having first and second opposite ends 304 and 305. The longitudinal distance between ends 304 and 305 preferably is about 45 inches.

The muffler 300 includes an inlet tube 306, projecting from end 304, and an outlet tube 307, projecting from end 305. In operation, engine noise and exhaust are directed into the muffler 300 through inlet tube 306, with the exhaust eventually passing outwardly through outlet tube 307.

Inlet tube 306 is secured within end 304 by baffles 309 and 320. Baffle 309 is an end baffle enclosing end 304, and has a central aperture 323 through which inlet tubes 306 extends. Baffle 309 can be a standard baffle for an 10-inch diameter muffler.

As indicated previously, inlet tube 306 is also secured in position by extending through baffle 320. Baffle 320 preferably is a solid, unperforated baffle. The baffle 320 includes a central aperture 324 through which inlet tube 306 extends, and by which inlet tube 306 is secured in position, for example through a weld. Note that the inlet tube 306 preferably includes open grooves or slots 332. These slots 332 can be for aiding connection and clamping to other tubes in the exhaust assembly.

Attention is now directed to region 327 of inlet tube 306. Region 327 preferably comprises a perforated section 328 of inlet tube 306 positioned between baffles 309 and 320. As a result of perforated section 328, exhaust gasses and exhaust sound entering muffler 300, through inlet tube 306, can expand into volume 330 between baffles 309 and 320. Volume 330 acts as an expansion-can resonator.

Continuing inwardly and away from end 304, the inlet tube 306 has a solid, unperforated region 333. Moving further inwardly from solid region 333, perforated region 336 is encountered. Perforated region 336 allows exhaust gasses and sound within inlet tube 306 to expand into volume 338.

Beyond perforated region 336, inwardly is positioned crimped end section 340. Preferably, crimped end section 340 is a "star crimp" construction. Inlet tube 306 is designed to function as a full choke.

Attention is now directed to the outlet tube construction 350. Outlet tube construction 350, in the embodiment illustrated, has four main regions: a choke extension 352; a diverging section 354; a bell 362; and an outlet section 356. The outlet tube construction 350 has a total length, from end 358 to the portion 360 that ends at the end 305 of at least 20 in., typically 30–35 in. At the end 358 is bell 362. The bell 362 helps to direct gas flow inwardly trough the outlet tube construction 350. Adjacent to the bell 362 is the choke extension 352. The choke extension 352 is preferably cylindrical in shape, with a diameter of at least 2 inches, no greater than 4 inches, and typically 3.0 inches. The choke extension 352 will have a length at least 5 inches, no greater than 30 inches, and typically 7–15 inches. Among other tings, the choke extension 352 functions to attenuate low frequency octave bands, on the order of 350 Hz and below.

Adjacent to the choke extension 352 and moving in a direction toward end 305, there is the diverging section 354. The diverging section 354 has a tapered or angled sidewall 364 that angles in a direction radially outwardly, extending from the choke extension 352 toward the outlet section 356. In particular, the sidewall 364 extends at an angle relative to the longitudinal axis 350*b* of at least 5°, no greater than about 13°, and typically about 8°. Preferably, the wall 364 has a circular cross-section, such that the diverging region 354 forms a frusto-conical section. A portion 357 of the diverging region 354 is perforated, to permit gas flow to travel from the outlet tube construction 350 into the volume 366. The projected length of the diverging section 354 is at least 5 inches, no greater than 30 inches, and typically 6–15 inches. It can be seen that the preferred ratio of the length of the diverging section 354 to the length of the choke extension 352 is less than 2.0:1, typically less than 1.5:1 and in this case, about 0.9:1–1.2:1.

Adjacent to the diverging section 354 is the outlet tube section 356. This is defined as the section between the end 305 of the muffler 300 and the point at which the diverging wall 364 stops diverging and is shaped in a straight, cylindrical section. Note that there are pair of baffles 368, 370 that hold the outlet tube 350 in place relative to the outer shell 302 adjacent to the end 305. There is a volume 372 defined between baffle 368 and baffle 370. The extension 374 of outlet tube section 356 that extends between baffle 368 and baffle 370 is perforated, to allow exhaust gas to flow into the volume 372.

The outlet tube section 356 further continues from extension 374 to end 305. Beyond end 305, there is a portion 376 with a plurality of slots 378, which allow fastening and connection to other exhaust flow tubes.

The diverging section 354 will have a greatest area of diameter at the point in which it terminates, and where the outlet section 356 begins. The diameter of the diverging section 354 at this point will be greater than the diameter of the choke extension 352. In this case, the diameter of the diverging section 354 will be at least 4 inches, and typically about 5 inches. A ratio of the cross-sectional area of the diverging section as compared to the cross-sectional area of the choke will be greater than 1.5:1, typically greater than 2.0:1, and in this case, about 2.8:1.

The baffle 351 has an aperture 353 for accommodating the outlet tube construction 350. As with the previously described embodiments, the baffle 351 also includes a bleed hole or an aperture arrangement 355 to permit gas flow between the inlet chamber 338 and the outlet chamber 366 and to achieve the advantages also described above. The aperture arrangement 355 includes at least one, no more than ten, and in some cases four apertures extending completely through the baffle 351. Usable ratios of the total open area of the aperture arrangement as compared to the total, cross-sectional, perimeter area of the baffle 351 are as follows: at least 1:77, no greater than 1:484, and preferably 1:250–1:350.

3. The Embodiment of FIG. 7

Figure 7:
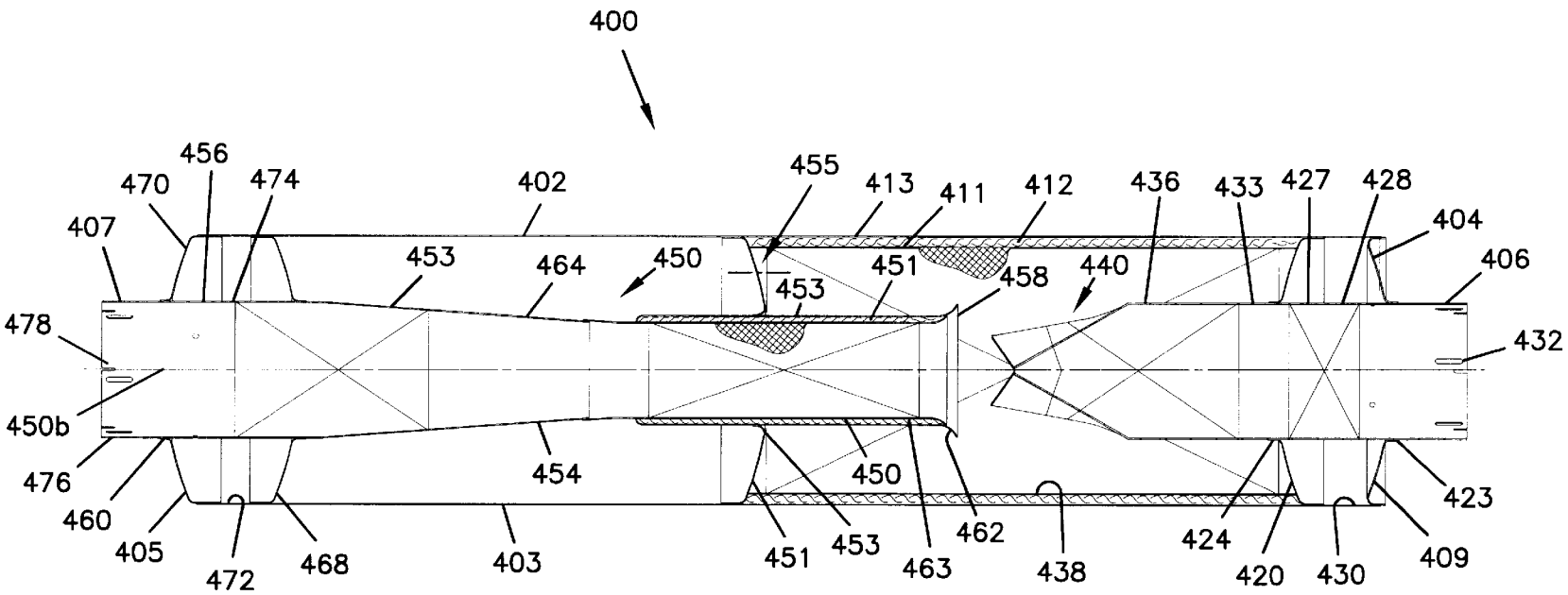
FIG. 7 is a schematic, cross-sectional view of a fifth embodiment of a muffler arrangement, constructed according to principles of this disclosure.

Attention is directed now to FIG. 7. In FIG. 7, another improved muffler design constructed according to principles of this disclosure is generally presented. As with the embodiment of FIG. 5, the specific muffler design of FIG. 7 has an overall outer diameter of about 10 inches and an overall length of the outer shell of about 45 inches. The muffler of FIG. 7 is particularly suited for use with a single vertical exhaust system (SVV). As described below, it is also well suited for use with engines equipped with engine compression brakes.

Referring still to FIG. 7, the improved muffler is generally indicated at reference 400. The muffler 400 includes an outer casing, shell, or body 402 with an outer wall 403 having first and second opposite ends 404 and 405. The longitudinal distance between ends 404 and 405 preferably is about 45 inches.

The muffler 400 includes an inlet tube 406, projecting from end 404, and an outlet tube 407, projecting from end 405. In operation, engine noise and exhaust are directed into the muffler 400 through inlet tube 406, with the exhaust eventually passing outwardly through outlet tube 407.

Inlet tube 406 is secured within end 404 by baffles 409 and 420. Baffle 409 is an end baffle enclosing end 404, and has a central aperture 423 through which inlet tubes 406 extends. Baffle 409 can be a standard baffle for an 10-inch diameter muffler.

As indicated previously, inlet tube 406 is also secured in position by extending through baffle 420. Baffle 420 preferably is a solid, unperforated baffle. The baffle 420 includes a central aperture 424 through which inlet tube 406 extends, and by which inlet tube 406 is secured in position, for example through a weld. Note that the inlet tube 406 preferably includes open grooves or slots 432. These slots 432 can be for aiding connection and clamping to other tubes in the exhaust assembly.

Attention is now directed to region 427 of inlet tube 406. Region 427 preferably comprises a perforated section 428 of inlet tube 406 positioned between baffles 409 and 420. As a result of perforated section 428, exhaust gasses and exhaust sound entering muffler 400, through inlet tube 406, can expand into volume 430 between baffles 409 and 420. Volume 430 acts as an expansion-can resonator.

Continuing inwardly and away from end 404, the inlet tube 406 has a solid, unperforated region 433. Moving further inwardly from solid region 433, perforated region 436 is encountered. Perforated region 436 allows exhaust gasses and sound within inlet tube 406 to expand into volume 438.

Beyond perforated region 436, inwardly is positioned crimped end section 440. Preferably, crimped end section 440 is a "star crimp" construction. Inlet tube 406 is designed to function as a full choke.

Spaced from the outer wall 402 is an inner wall 411. The inner wall 411 extends between baffle 420 and 451. Preferably, the inner wall 411 is spaced about ⅛–¾ inches, typically about ⅜ inches from the outer wall 402 to define an annular volume 412 therebetween. The volume 412 is filled with packing material 413, typically fiberglass packing. This helps to attenuate noise, on the order of greater than 500 Hz. High frequency noise is often problematic when utilizing engine compression brakes. More details regarding the use of packing materials in mufflers and the noise problems associated with engine compression brakes are discussed in U.S. Pat. No. 6,082,487, and application Ser. No. 09/571,342 filed May 16, 2000 which is incorporated herein by reference. Packing material, such as fiberglass packing, can be used in an analogous manner in other embodiments, such as the embodiments depicted in FIGS. 3–6, in order to achieve certain results, such as high frequency noise attenuation.

Attention is now directed to the outlet tube construction 450. Outlet tube construction 450, in the embodiment illustrated, has four main regions: a choke extension 452; a diverging section 454; a bell 462; and an outlet section 456. The outlet tube construction 450 has a total length, from end 458 to the portion 460 that ends at the end 405 of at least 20 in., typically 25–35 in. At the end 458 is bell 462. The bell 462 helps to direct gas flow inwardly through the outlet tube construction 450. Adjacent to the bell 462 is the choke extension 452. The choke extension 452 is preferably cylindrical in shape, with a diameter of at least 2 inches, no greater than 4 inches, and typically 3.0 inches. The choke extension 452 will have a length at least 5 inches, no greater than 30 inches, and typically 7–15 inches. Among other things, the choke extension 452 functions to attenuate low frequency octave bands, on the order of 350 Hz and below.

The choke extension 452 is preferably perforated and circumscribed by a wall 453. The wall 453 is spaced at least about 0.1 inch, and no greater than about 1 inch from the choke extension 452. Between the wall 453 and the choke extension 452, the volume 451 is filled with a packing material 463, preferably, fiberglass packing. The packing material 463 helps to attenuate high frequencies associated with engine compression braking.

Adjacent to the choke extension 452 and moving in a direction toward end 405, there is the diverging section 454. The diverging section 454 has a tapered or angled sidewall 464 that angles in a direction radially outwardly, extending from the choke extension 452 toward the outlet section 456. In particular, the sidewall 464 extends at an angle relative to the longitudinal axis 450*b* of at least 5°, no greater than about 13°, and typically about 8°. Preferably, the wall 464 has a circular cross-section, such that the diverging region 454 forms a frusto-conical section. A portion 453 of the diverging region 454 is perforated, to permit gas flow to travel from the outlet tube construction 450 into the volume 466. The projected length of the diverging section 454 is at least 5 inches, no greater than 30 inches, and typically 6–15 inches. It can be seen that the preferred ratio of the length of the diverging section 454 to the length of the choke extension 452 is less than 1.5:1, typically less than 1.0:1 and in this case, about 0.7:1–0.9:1.

Adjacent to the diverging section 454 is the outlet tube section 456. This is defined as the section between the end 405 of the muffler 400 and the point at which the diverging wall 464 stops diverging and is shaped in a straight, cylindrical section. Note that there are pair of baffles 468, 470 that hold the outlet tube 450 in place relative to the outer shell 402 adjacent to the end 405. There is a volume 472 defined between baffle 468 and baffle 470. The extension 474 of outlet tube section 456 that extends between baffle 468 and baffle 470 is perforated, to allow exhaust gas to flow into the volume 472.

The outlet tube section 456 further continues from extension 474 to end 405. Beyond end 405, there is a portion 476 with a plurality of slots 478, which allow fastening and connection to other exhaust flow tubes.

The diverging section 454 will have a greatest area of diameter at the point in which it terminates, and where the outlet section 456 begins. The diameter of the diverging section 454 at this point will be greater than the diameter of the choke extension 452. In this case, the diameter of the diverging section 454 will be at least 3 inches, and typically about 5 inches. A ratio of the cross-sectional area of the diverging section as compared to the cross-sectional area of the choke will be greater than 1.5:1, typically greater than 1.75:1, and in this case, about 2.0:1.

The baffle 451 has an aperture 453 for accommodating the outlet tube construction 450. As with the previously described embodiments, the baffle 451 also includes a bleed hole or an aperture arrangement 455 to permit gas flow between the inlet chamber 438 and the outlet chamber 466 and to achieve the advantages also described above. The aperture arrangement 455 includes at least one, no more than ten, and in some cases four apertures extending completely through the baffle 451. Usable ratios of the total open area of the aperture arrangement as compared to the total, cross-sectional, perimeter area of the baffle 451 are as follows: at least 1:77, no greater than 1:484, and preferably 1:200–1:400.

4. The Embodiment of FIG. 8

Figure 8:
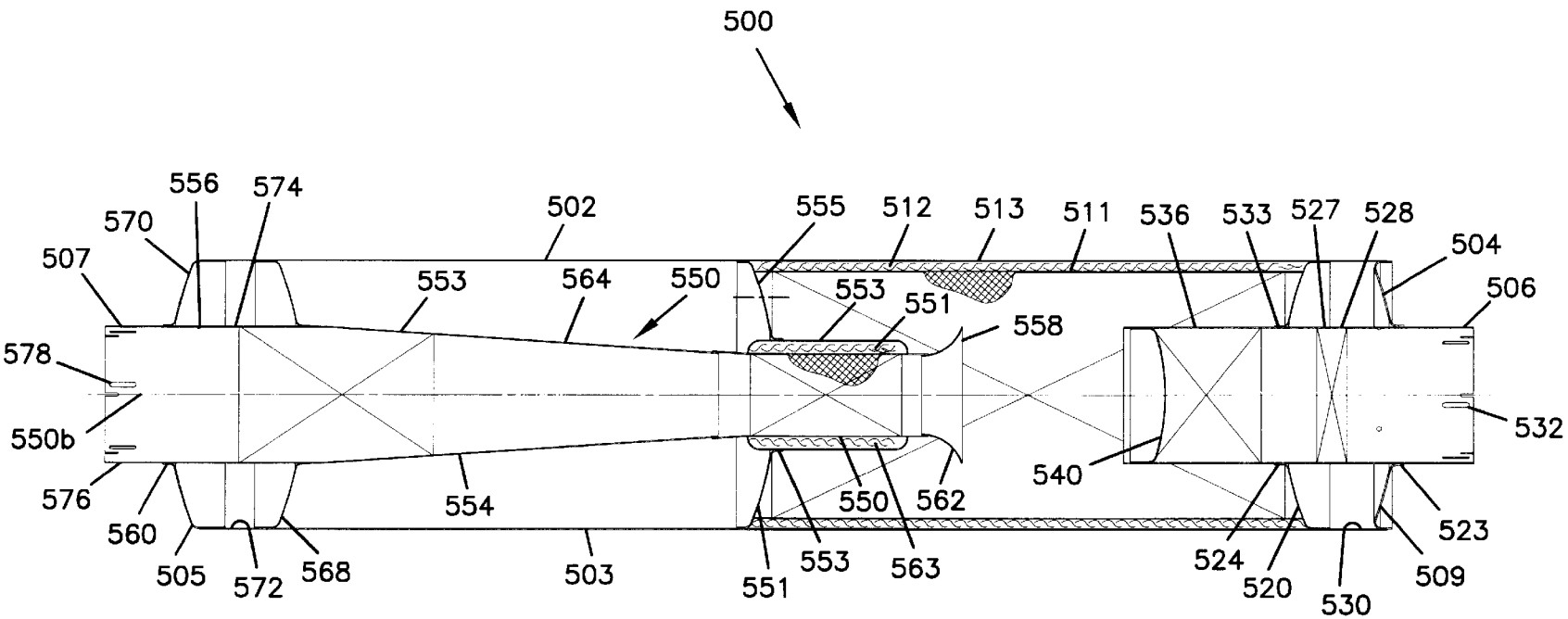
FIG. 8 is a schematic, cross-sectional view of a sixth embodiment of a muffler arrangement, constructed according to principles of this disclosure.

In FIG. 8, another improved muffler design constructed according to principles of this disclosure is generally presented. The specific muffler design of FIG. 8 has an overall outer diameter of about 10 inches and an overall length of the outer shell of about 45 inches. The muffler of FIG. 8 is particularly suited for use with a dual vertical exhaust system (DVV). As described below, it is also well suited for use with engines equipped with engine compression brakes.

Referring still to FIG. 8, the improved muffler is generally indicated at reference 500. The muffler 500 includes an outer casing, shell, or body 502 with an outer wall 503 having first and second opposite ends 504 and 505. The longitudinal distance between ends 504 and 505 preferably is about 45 inches.

The muffler 500 includes an inlet tube 506, projecting from end 504, and an outlet tube 507, projecting from end 505. In operation, engine noise and exhaust are directed into the muffler 500 through inlet tube 506, with the exhaust eventually passing outwardly through outlet tube 507.

Inlet tube 506 is secured within end 504 by baffles 509 and 520. Baffle 509 is an end baffle enclosing end 504, and has a central aperture 523 through which inlet tubes 506 extends. Baffle 509 can be a standard baffle for an 10-inch diameter muffler.

As indicated previously, inlet tube 506 is also secured in position by extending through baffle 520. Baffle 520 preferably is a solid, unperforated baffle. The baffle 520 includes a central aperture 524 through which inlet tube 506 extends, and by which inlet tube 506 is secured in position, for example through a weld. Note that the inlet tube 506 preferably includes open grooves or slots 532. These slots 532 can be for aiding connection and clamping to other tubes in the exhaust assembly.

Attention is now directed to region 527 of inlet tube 506. Region 527 preferably comprises a perforated section 528 of inlet tube 506 positioned between baffles 509 and 520. As a result of perforated section 528, exhaust gasses and exhaust sound entering muffler 500, through inlet tube 506, can expand into volume 530 between baffles 509 and 520. Volume 530 acts as an expansion-can resonator.

Continuing inwardly and away from end 504, the inlet tube 506 has a solid, unperforated region 533. Moving further inwardly from solid region 533, perforated region 536 is encountered. Perforated region 536 allows exhaust gasses and sound within inlet tube 506 to expand into volume 538.

Beyond perforated region 536, inwardly is positioned unperforated end section 540. Preferably, end section 540 is a non-crimped construction. Inlet tube 506 is designed to function as a full choke.

Spaced from the outer wall 502 is an inner wall 511. The inner wall 511 extends between baffle 520 and 551. Preferably, the inner wall 511 is spaced about ⅛–¾ inch, typically, about ⅜ in., from the outer wall 502 to define an annular volume 512 therebetween. The volume 512 is filled with packing material 513, typically fiberglass packing. This helps to attenuate noise, on the order of greater than 500 Hz. High frequency noise is often problematic when utilizing engine compression brakes. More details regarding the use of packing materials in mufflers and the noise problems associated with engine compression brakes are discussed in U.S. Pat. No. 6,082,487, which is incorporated herein by reference.

Attention is now directed to the outlet tube construction 550. Outlet tube construction 550, in the embodiment illustrated, has four main regions: a choke extension 552; a diverging section 554; a bell 562; and an outlet section 556. The outlet tube construction 550 has a total length, from end 558 to the portion 560 that ends at the end 505 of at least 20 in., typically 30–35 in. At the end 558 is bell 562. The bell 562 helps to direct gas flow inwardly through the outlet tube construction 550. Adjacent to the bell 562 is the choke extension 552. Among other things, the choke extension 552 is preferably cylindrical in shape, with a diameter of at least 2 inches, no greater than 4 inches, and typically 3.0 inches. The choke extension 552 will have a length at least 5 inches, no greater than 30 inches, and typically 7–15 inches. The choke extension 552 functions to attenuate low frequency octave bands, on the order of 350 Hz and below.

The choke extension 552 is preferably perforated and circumscribed by a wall 553. The wall 553 is spaced at least about 0.1 inches, no greater than about 1 inch and typically about 0.4–0.6 in. from the choke extension 552. Between the wall 553 and the choke extension 552, the volume 551 is filled with a packing material 563, preferably, fiberglass packing. The packing material 562 helps to attenuate high frequencies associated with engine compression braking.

Adjacent to the choke extension 552 and moving in a direction toward end 505, there is the diverging section 554. The diverging section 554 has a tapered or angled sidewall 564 that angles in a direction radially outwardly, extending from the choke extension 552 toward the outlet section 556. In particular, the sidewall 564 extends at an angle relative to the longitudinal axis 550*b* of at least 5°, no greater than about 13°, and typically about 8°. Preferably, the wall 564 has a circular cross-section, such that the diverging region 554 forms a frusto-conical section. The entire portion of the diverging region 554 is perforated, to permit gas flow to travel from the outlet tube construction 550 into the volume 566. The projected length of the diverging section 554 is at least 5 inches, no greater than 30 inches, and typically 10–25 inches. It can be seen that the preferred ratio of the length of the diverging section 554 to the length of the choke extension 552 is less than 3.0:1, typically less than 2.5:1 and in this case, 1.6:1–2:1.

Adjacent to the diverging section 554 is the outlet tube section 556. This is defined as the section between the end 505 of the muffler 500 and the point at which the diverging wall 564 stops diverging and is shaped in a straight, cylindrical section. Note that there are pair of baffles 568, 570 that hold the outlet tube 550 in place relative to the outer shell 502 adjacent to the end 505. There is a volume 572 defined between baffle 568 and baffle 570. The extension 574 of outlet tube section 556 that extends between baffle 568 and baffle 570 is perforated, to allow exhaust gas to flow into the volume 572.

The outlet tube section 556 further continues from extension 574 to end 505. Beyond end 505, there is a portion 576 with a plurality of slots 578, which allow fastening and connection to other exhaust flow tubes.

The diverging section 554 will have a greatest area of diameter at the point in which it terminates, and where the outlet section 556 begins. The diameter of the diverging section 554 at this point will be greater than the diameter of the choke extension 552. In this case, the diameter of the diverging section 554 will be at least 3 inches, and typically about 5 inches. A ratio of the cross-sectional area of the diverging section as compared to the cross-sectional area of the choke will be greater than 1.5:1, typically greater than 1.75:1, and in this case, about 2.75:1.

The baffle 551 has an aperture 553 for accommodating the outlet tube construction 550. As with the previously described embodiments, the baffle 551 also includes a bleed hole or an aperture arrangement 555 to permit gas flow between the inlet chamber 538 and the outlet chamber 566 and to achieve the advantages also described above. The aperture arrangement 555 includes at least one, no more than ten, and in some cases four apertures extending completely through the baffle 551. Usable ratios of the total open area of the aperture arrangement as compared to the total, cross-sectional, perimeter area of the baffle 551 are as follows: at least 1:77, no greater than 1:484, and preferably 1:250–1:350.

5. Common Properties of 10 Inch Mufflers

In general, many preferred mufflers having shell diameters of 10 inches will have a choke length that is at least 7 inches, no greater than 30 inches, and typically about 8–15 inches. Typically, the length of the diverging section will at least 5 inches, no greater than 30 inches, and typically about 8–25 inches.

For 10-inch mufflers, the ratio of the diverging section to the choke in many arrangements will be less than 3.0:1, typically less than 2.5:1. In many instances, the ratio of the length of the diverging section to the length of the choke will be less than 1.0:1.

Further, for many arrangements, 10-inch mufflers will also have the aperture arrangement or a bleed hole in the baffle that separates the inlet chamber from the outlet chamber. As described above, this aperture arrangement helps to reduce back pressure through the choke, provide uniform temperature throughout the interior of the muffler, and result in an outlet tube construction with straight walls that is anti-whistle bead free.

For many mufflers, they will be constructed of metal, usually steel. Many parts are constructed of 14–20 gauge steel.

C. Installation

The muffler arrangements of FIGS. 3–8 can be mounted in a variety of locations on a truck, relative to the driver's position. Where and how the muffler is installed can affect the amount and the sound quality of in-cab noise.

Figure 2:
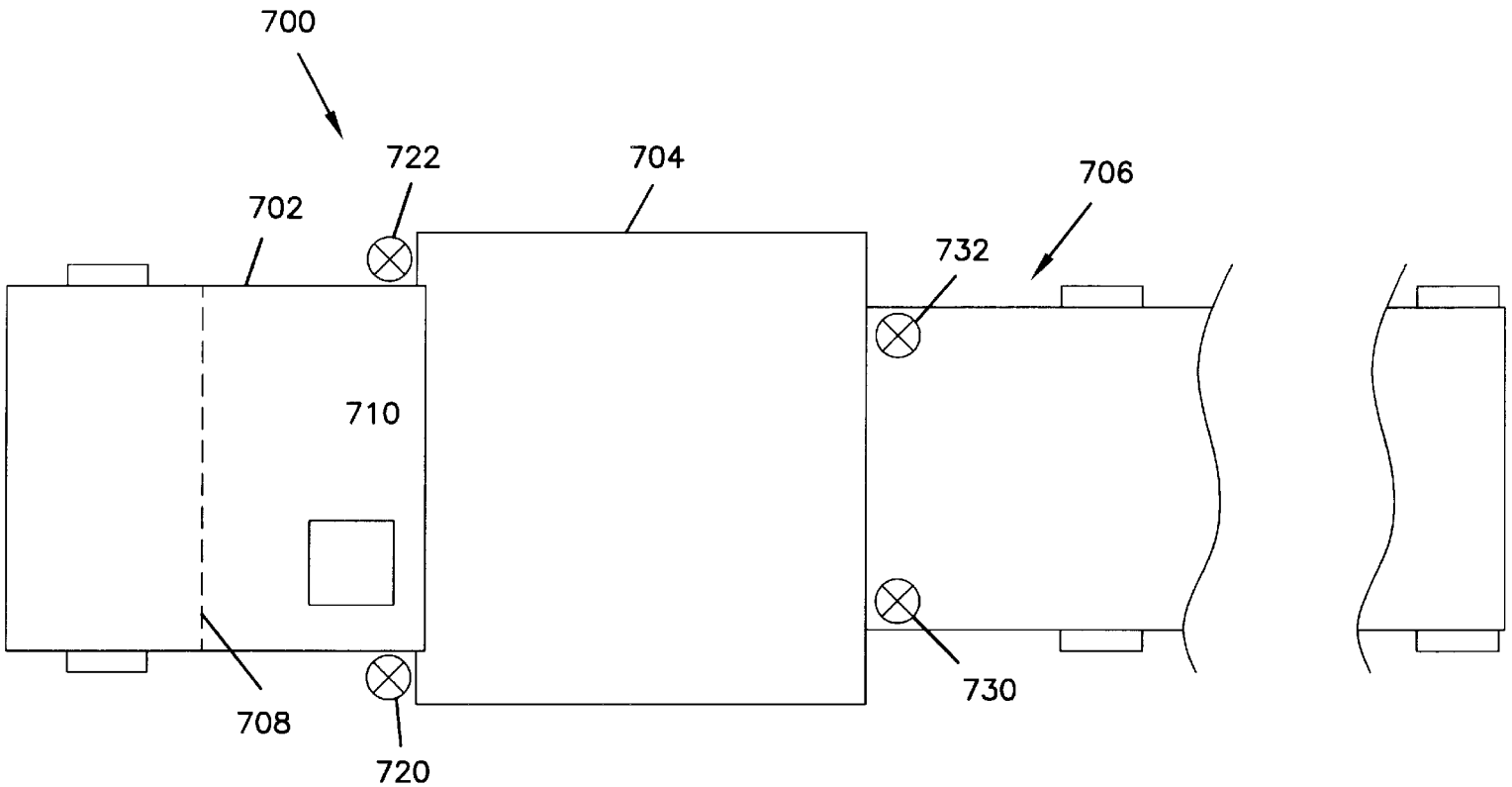
FIG. 2 is a schematic, fractional, top plan view of a cab of the truck with a sleeper cab and an exhaust system.

Attention is directed to FIGS. 1 and 2. FIG. 1 shows a schematic view of a typical heavy duty truck 600 having an exhaust system 602 and a cab 603. A muffler is shown (under a heat shield 605) at 604 mounted on the truck frame 606, and in gas flow communication with the exhaust system 602.

In FIG. 1, the muffler 604 is shown secured to the truck fame 606 through a mounting arrangement 608. In some instances, mufflers are secured directly to a sidewall of the cab. This can exasperate in-cab noise problems.

FIG. 2 shows a schematic, fractional, top plan view of a truck 700. This view illustrates some of the common places a muffler will be mounted, relative to the position of the driver. In FIG. 2, the truck 700 has a cab 702 and a sleeper 704. The cargo area of the truck is shown at 706, with a portion of the length broken away. In the cab 702, the windshield 708 is schematically depicted as a broken line. A driver seat 710 is illustrated schematically in the cab 702 to generally indicate the position of the driver. Inside of the sleeper 704, there may typically be a bed, cot, or other sleeping arrangements.

Typical places that mufflers are often mounted are illustrated in FIG. 2. For example, one typical place mufflers are mounted is adjacent to the cab 702 and in front of the sleeper 704. The muffler can be on the driver's side, such as position 720, or on the passenger side, such as position 722. Another typical place that mufflers are often mounted is behind the sleeper 704. Again, this can be on the driver's side such as 730, or on the passenger side, such as position 732. Depending on where the muffler is mounted, there will be different sound properties and noise levels conveyed to the person in the driver's seat 710 and the person resting in the sleeper 704.

The above specification, examples and data provide a complete description of the manufacture and use of the invention. Many embodiments of the invention can be made.

What is claimed is:

1. A muffler arrangement comprising:

(a) an outer wall defining an internal volume and having first and second, opposite ends; said outer wall having an outer dimension of at least 9.5 inches and an axial length between said first and second ends of less than or equal to 60 inches;

(b) an inlet tube construction oriented at least partially within said internal volume and adjacent to said first end;

(c) an outlet tube construction oriented at least partially within said internal volume and adjacent to said second end; said outlet tube construction including a diverging section and a choke extension;

(i) said choke extension being oriented between said inlet tube and said diverging section;

(ii) said diverging section having first and second, opposite ends and a diverging section axial length;

(iii) said choke extension having first and second, opposite ends and a choke extension axial length;

(iv) a ratio of said diverging section axial length to said choke extension axial length being less than 3:1; and (d) a first baffle structure circumscribing said outlet tube construction within said internal volume; said first baffle structure defining an outlet tube aperture circumscribing said outlet tube construction and a bleed aperture arrangement therein to permit gas flow communication therethrough;

(i) said bleed aperture arrangement having a total open area;

(ii) said first baffle structure having a perimeter, cross-sectional area; and (iii) a ratio of said total open area of said bleed aperture arrangement to said perimeter, cross-sectional area of said first baffle structure being between 1:500 and 1:50.

2. A muffler arrangement according to claim 1 wherein:

(a) a ratio of said diverging section axial length to said choke extension axial length is less than 2.5:1; and (b) said outer wall has an outer dimension of no greater than 12 inches.

3. A muffler arrangement according to claim 2 wherein:

(a) a ratio of said total open area of said bleed aperture arrangement to said perimeter, cross-sectional area of said first baffle structure is between 1:400 and 1:200.

4. A muffler arrangement according to claim 3 wherein:

(a) said diverging section includes perforations; and (b) said first baffle structure is secured to said outer wall and divides said internal volume between an inlet volume and an outlet volume;

(i) said aperture arrangement permitting gas flow communication between said inlet volume and said outlet volume.

5. A muffler arrangement according to claim 4 further including:

(a) an inlet baffle structure securing said inlet tube within said inlet volume; and (b) an outlet baffle structure; said first baffle structure and said outlet baffle structure securing said outlet tube construction within said outlet volume.

6. A muffler arrangement according to claim 5 wherein:

(a) said diverging section first end is immediately adjacent to said choke extension second end; and said diverging section second end is immediately adjacent to said outlet baffle structure; and (b) the muffler arrangement further includes a bell immediately adjacent to said choke extension first end.

7. A muffler arrangement according to claim 6 wherein:

(a) said inlet tube includes a full choke.

8. A muffler arrangement according to claim 7 wherein:

(a) said inlet tube includes a non-crimped construction.

9. A muffler arrangement according to claim 7 wherein:

(a) said inlet tube includes a crimped construction.

10. A muffler arrangement according to claim 7 wherein:

(a) said choke extension axial length is at least 15 inches;

(b) said diverging section axial length is no greater than 12 inches;

(c) said outer wall has a nominal diameter of 11 inches; and (d) said choke extension is non-perforated.

11. A muffler arrangement according to claim 10 wherein:

(a) a ratio of said diverging section axial length to said choke extension axial length is less than 0.67:1.

12. A muffler arrangement according to claim 7 wherein:

(a) said choke extension axial length is at least 7 inches;

(b) said diverging section axial length is no greater than 30 inches; and (c) said outer wall has a nominal diameter of 10 inches.

13. A muffler arrangement according to claim 12 wherein:

(a) said choke extension is non-perforated.

14. A muffler arrangement according to claim 13 wherein:

(a) a ratio of said diverging section axial length to said choke extension axial length is less than 1:1.

15. A muffler arrangement according to claim 12 further including:

(a) a first, inner perforated wall spaced from said outer wall and defining a first, annular volume therebetween;

(b) a first region of packing material positioned within said first annular volume;

(c) a second, inner wall spaced from at least a portion of said choke extension and defining a second annular volume therebetween; and (d) a second region of packing material positioned within said second annular volume.

16. A muffler arrangement according to claim 15 wherein:

(a) said choke extension includes perforations; and (b) a ratio of said diverging section axial length to said choke extension axial length is less than 1:1.

17. A truck having:

(a) an engine rated for operation, at a rated rpm at a selected rpm value of 1800 or above, for a power of at least 300 hp; and (b) an exhaust muffler system including at least one vertical muffler; each vertical muffler of said exhaust system including:

(i) a cylindrical outer shell defining an internal volume; said shell having an outside diameter of at least 9.5 inches and an overall length of no greater than 60 inches;

(ii) an inlet tube construction oriented at least partially within said internal volume;

(iii) an outlet tube construction oriented at least partially within said internal volume; said outlet tube construction including a diverging section and a choke extension;

(A) said choke extension being oriented between said inlet tube and said diverging section;

(B) said diverging section having first and second, opposite ends and a diverging section axial length;

(C) said choke extension having first and second, opposite ends and a choke extension axial length;

(D) a ratio of said diverging section axial length to said choke extension axial length being less than 3:1; and (iv) a first baffle structure circumscribing said outlet tube construction within said internal volume; said first baffle structure defining an outlet tube aperture circumscribing said outlet tube construction and a bleed aperture arrangement therein to permit gas flow communication therethrough;

(A) said bleed aperture arrangement having a total open area;

(B) said first baffle structure having a perimeter, cross-sectional area; and (C) a ratio of said total open area of said bleed aperture arrangement to said perimeter, cross-sectional area of said first baffle structure being between 1:50 and 1:500.

18. A method of muffling an engine rated for operation, at a rated rpm at a selected rpm value of 1800 or above, for a power of at least 300 hp; the method comprising:

(a) directing exhaust gas flow from the engine into a muffler; the muffler including:

(i) a cylindrical outer shell defining an internal volume; the shell having an outside diameter of at least 9.5 inches and an overall length of no greater than 60 inches;

(ii) an inlet tube construction oriented at least partially within the internal volume;

(iii) an outlet tube construction oriented at least partially within the internal volume; the outlet tube construction including a diverging section and a choke extension;

(A) the choke extension being oriented between the inlet tube and the diverging section;

(B) the diverging section having first and second, opposite ends and a diverging section axial length;

(C) the choke extension having first and second, opposite ends and a choke extension axial length;

(D) a ratio of the diverging section axial length to the choke extension axial length being less than 3:1; and (iv) a first baffle structure circumscribing the outlet tube construction within the internal volume; said first baffle structure defining an outlet tube aperture circumscribing said outlet tube construction and a bleed aperture arrangement therein to permit gas flow communication therethrough;

(A) the bleed aperture arrangement having a total open area;

(B) the first baffle structure having a perimeter, cross-sectional area; and (C) a ratio of the total open area of the bleed aperture arrangement to the perimeter, cross-sectional area of the first baffle structure being between 1:50 and 1:500.

* * * * *